US008412085B2

(12) United States Patent
Kodera et al.

(10) Patent No.: US 8,412,085 B2
(45) Date of Patent: Apr. 2, 2013

(54) FIXING DEVICE, IMAGE FORMING APPARATUS, AND TONER IMAGE FIXING METHOD

(75) Inventors: Tetsuro Kodera, Ashigarakami-gun (JP); Naoyuki Egusa, Ashigarakami-gun (JP); Makoto Furuki, Ashigarakami-gun (JP); Miho Watanabe, Ashigarakami-gun (JP); Takashi Matsubara, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 412 days.

(21) Appl. No.: 12/774,322

(22) Filed: May 5, 2010

(65) Prior Publication Data

US 2011/0058867 A1 Mar. 10, 2011

(30) Foreign Application Priority Data

Sep. 4, 2009 (JP) ..... 2009-204852
Feb. 5, 2010 (JP) ..... 2010-023825

(51) Int. Cl.
*G03G 15/20* (2006.01)

(52) U.S. Cl. ..... 399/335

(58) Field of Classification Search ..... 399/335–337, 399/122

See application file for complete search history.

(56) References Cited

U.S. PATENT DOCUMENTS

| | | | | |
|---|---|---|---|---|
| 7,440,722 | B2 * | 10/2008 | Lofthus et al. | 399/328 |
| 2011/0038653 | A1 * | 2/2011 | Egusa et al. | 399/336 |
| 2011/0222935 | A1 * | 9/2011 | Egusa et al. | 399/336 |

FOREIGN PATENT DOCUMENTS

| | | | |
|---|---|---|---|
| JP | 57-002069 | A | 1/1982 |
| JP | 07-191560 | A | 7/1995 |
| JP | 2007-057903 | A | 3/2007 |
| JP | 2008-089828 | A | 4/2008 |

* cited by examiner

*Primary Examiner* — Walter L Lindsay, Jr.
*Assistant Examiner* — Rodney Bonnette
(74) *Attorney, Agent, or Firm* — Sughrue Mion, PLLC

(57) ABSTRACT

According to an aspect of the invention, a fixing device includes a laser beam irradiation unit and a conveying unit. The laser beam irradiation unit includes a plurality of laser beam sources and emits a plurality of laser beams to a surface of a recording medium. The conveying unit conveys the recording medium and/or the laser beam irradiation unit so that irradiated regions irradiated with the laser beams are moved in a given direction. When the plurality of laser beams is emitted to a toner image to fix the toner image, the plurality of laser beams satisfies conditions (A) and (B). The condition (A) is that the plurality of laser beams has substantially the same beam power and substantially the same width. The condition (B) is that the plurality of laser beams is independently emitted to the toner image.

5 Claims, 9 Drawing Sheets

*FIG. 11*

| | EVALUATION | |
|---|---|---|
| | FIXING PROPERTY OF IMAGE REGION | FIXING PROPERTY OF NONIMAGE REGION |
| EXAMPLE 1 | A | A |
| EXAMPLE 2 | B | A |
| COMPARATIVE EXAMPLE 1 | C | A |
| COMPARATIVE EXAMPLE 2 | A | C |

FIXING DEVICE, IMAGE FORMING APPARATUS, AND TONER IMAGE FIXING METHOD

CROSS-REFERENCE TO RELATED APPLICATIONS

This application is based upon and claims priority under 35 USC 119 from Japanese Patent Application Nos. 2009-204852, filed Sep. 4, 2009, and 2010-023825, filed Feb. 5, 2010.

BACKGROUND

Technical Field

The present invention relates to a fixing device, an image forming apparatus using the fixing device, and a toner image fixing method.

SUMMARY OF THE INVENTION

According to an aspect of the invention, a fixing device includes a laser beam irradiation unit and a conveying unit. The laser beam irradiation unit includes a plurality of laser beam sources and emits a plurality of laser beams, generated by the laser beam sources, to a surface of a recording medium. The conveying unit conveys the recording medium and/or the laser beam irradiation unit so that irradiated regions, on the recording medium, irradiated with the laser beams are moved in a given direction relative to the conveyed recording medium. When the plurality of laser beams is emitted to a toner image formed on the recording medium so as to fix the toner image to the recording medium, the plurality of laser beams satisfies conditions (A) and (B). The condition (A) is that the plurality of laser beams has substantially the same beam power and substantially the same width in the given direction in the irradiated regions. The condition (B) is that the plurality of laser beams is independently emitted to the toner image.

BRIEF DESCRIPTION OF THE DRAWINGS

Exemplary embodiments of the invention will be described in detail based on the following figures, wherein:

FIGS. 1A and 1B are views showing the outlines of an exemplary embodiment of a fixing device according to the invention, wherein FIG. 1A is a side view as seen in a direction crossing a conveying direction of a recording medium and FIG. 1B is a front view as seen in a direction following the conveying direction of a recording medium;

FIG. 11 is a table showing the results of evaluation of a fixing property of an image (toner image) fixed to a recording medium that are obtained from examples and comparative examples.

DETAILED DESCRIPTION

Figure 1A:
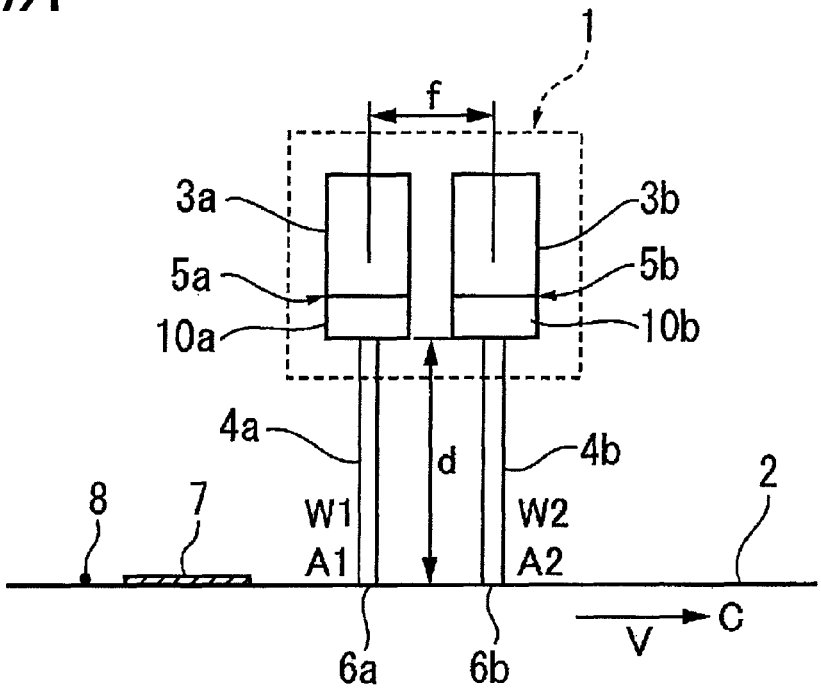
Figure 1B:
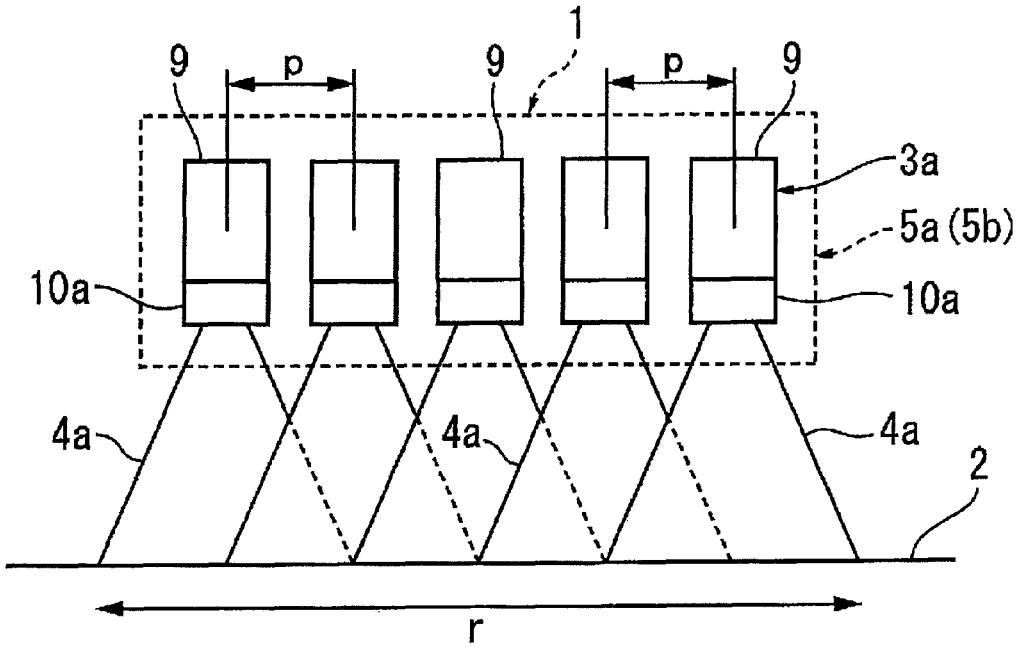

FIGS. 1A and 1B are view showing the outlines of an exemplary embodiment of a fixing device according to the invention, wherein FIG. 1A is a side view as seen in a direction crossing a conveying direction of a recording medium and FIG. 1B is a front view as seen in a direction following the conveying direction of a recording medium.

A fixing device 1 according to this exemplary embodiment includes a plurality of laser beam irradiation units 5*a* and 5*b*. The laser beam irradiation units are disposed so as to be spaced apart from the surface of a recording medium (for example, recording sheet) 2, which is conveyed in a direction indicated by an arrow C, by a distance d. The laser beam irradiation units diffuse laser beams 4*a* and 4*b*, which are generated from the laser beam sources 3*a* and 3*b*, over a predetermined distance in a width direction crossing a conveying direction C of the recording medium 2 and emit the laser beams so that the laser beams are narrowed with a predetermined distance in the conveying direction C. The laser beam irradiation units are disposed with a gap f therebetween in the conveying direction C of the recording medium 2. When the fixing device fixes a toner image to the recording medium 2 by irradiating toner images 7 and 8, which are formed on the recording medium 2, with the laser beams 4*a* and 4*b* generated from the plurality of laser beam irradiation units 5*a* and 5*b*, the plurality of laser beam irradiation units 5*a* and 5*b* satisfies the following conditions.

(A) The plurality of laser beams 4*a* and 4*b* has the same beam power and the same width of an irradiation region in one direction.

(B) The plurality of laser beams 4*a* and 4*b* is independently emitted to the toner images 7 and 8.

(C) If the toner images 7 and 8 include a plurality of toner layers, the toner temperature of interfacial portions between the images and the surface of the recording medium 2 reaches toner fixing temperature in the irradiation of at least the final laser beam except for the irradiation of the first laser beam among the irradiation of the plurality of laser beams 4*a* and 4*b*.

Meanwhile, "independently emitted" of (B) means not that the laser beam 4*b* is continuously emitted after the irradiation of the laser beam 4*a*, but that the laser beams 4*a* and 4*b* are intermittently emitted so that non-irradiation time exists between the irradiation of the laser beams.

In this exemplary embodiment, the first laser beam irradiation unit 5*a* diffuses a laser beam 4*a*, which is generated from one laser beam source 3*a*, over a predetermined distance in the width direction crossing the conveying direction C of the recording medium 2 and emits the laser beam so that the laser beam is narrowed with a predetermined distance in the conveying direction C. The first laser beam irradiation unit is disposed so as to be spaced apart from the surface of the recording medium 2 by the distance d.

Further, the second laser beam irradiation unit 5*b* diffuses a laser beam 4*b*, which is generated from another laser beam source 3*b*, over a predetermined distance in the width direction crossing the conveying direction C of the recording medium 2 and emits the laser beam so that the laser beam is narrowed with a predetermined distance in the conveying direction C. The second laser beam irradiation unit is disposed so as to be spaced apart from the surface of the recording medium 2 by the distance d. The first and second laser beam irradiation units 5*a* and 5*b* are disposed with the gap f therebetween in the conveying direction C of the recording medium 2. That is, the second laser beam irradiation unit 5*b* is positioned on the rear side of the first laser beam irradiation unit 5*a* with the gap f between the first and second laser beam irradiation units in the conveying direction C of the recording medium 2.

Further, the laser beams 4*a* and 4*b* generated from the first and second laser beam irradiation units 5*a* and 5*b* are emitted to the toner images 7 and 8 formed on the recording medium 2, so that the toner images are fixed to the recording medium 2. In this case, in this exemplary embodiment, the plurality of laser beam irradiation units 5*a* and 5*b* satisfy the following three conditions.

Condition 1 is as follows: assuming that the beam power of the laser beam 4*a* emitted from the first laser beam irradiation unit 5*a* is denoted by W1, the width of the irradiation region by the laser beam 4*a* in the one direction (hereinafter referred to as the width of the irradiation region) is denoted by A1, the beam power of the laser beam 4*b* emitted from the second laser beam irradiation unit 5*b* is denoted by W2, and the width of the irradiation region of the laser beam 4*b* is denoted by A2, the widths A1 and A2 of the irradiation regions and the beam powers W1 and W2 of the laser beams 4*a* and 4*b* are the same as each other (W1=W2 and A1=A2). Here, the fact that the widths of the irradiation regions and the beam powers of the laser beams 4*a* and 4*b* are the same as each other means as follows: for example, when the first and second laser beam irradiation units 5*a* and 5*b* are manufactured, the first and second laser beam irradiation units are designed so that the widths of the irradiation regions and the beam powers of the laser beams 4*a* and 4*b* are the same as each other. However, even though errors are generated in the beam powers and the widths of the irradiation regions during the manufacture of the first and second laser beam irradiation units, the errors are included in the range of "the same".

Condition 2 is as follows: the laser beams 4*a* and 4*b* emitted from the first and second laser beam irradiation units 5*a* and 5*b* are emitted to the toner images 7 and 8, which are formed on the recording medium 2 to be conveyed, several times at a predetermined time interval (for example, 5 ms). For this purpose, the recording medium 2 is conveyed in the conveying direction C at a predetermined conveying speed V (for example, 500 mm/s) by a conveying mechanism (not shown). In this case, since the widths of the irradiation regions and the beam powers of the laser beams 4*a* and 4*b* emitted from the first and second laser beam irradiation units 5*a* and 5*b* are the same as each other, the irradiation time (that is, time where the toner images formed on the recording medium are emitted with the laser beams) and the irradiation intensity of the laser beams per unit area of the recording medium 2 are the same as each other.

Condition 3 is as follows: the toner heating temperature of the interfacial portions between the surface of the recording medium 2 and the toner images 7 and 8 formed on the recording medium 2 reaches the toner fixing temperature in the irradiation of the laser beam 4*b*.

Here, in FIG. 1A, the toner image 7 is an unfixed toner image that is transferred to a high image density region (hereinafter referred to as a "toner image having high image density"), and the toner image 8 is an unfixed toner image that is transferred to a region having low image density (hereinafter referred to as a "toner image having low image density"). Further, the laser beams 4*a* and 4*b*, which are emitted from the first and second laser beam irradiation units 5*a* and 5*b* and satisfy Condition 3, are emitted to the toner image 8 having high image density and the toner image 7 having low image density, which are formed on the recording medium 2, so that the toner images are fixed to the recording medium 2. Accordingly, regardless of whether the image density of the image formed on the recording medium 2 is high or low, the unfixed toner image is fixed to the recording medium 2.

Meanwhile, the toner image having high image density means a state where much toner typified by a solid image is aggregated, and the toner image having low image density means a state where one or several toner particles typified by halftone or character portions are aggregated. Further, a state where isolated toner particles generated by fogging (a phenomenon where toner is attached to non-image portions to which toner should not be attached by the development) are attached is also included in the toner image having low image density.

Figure 2:
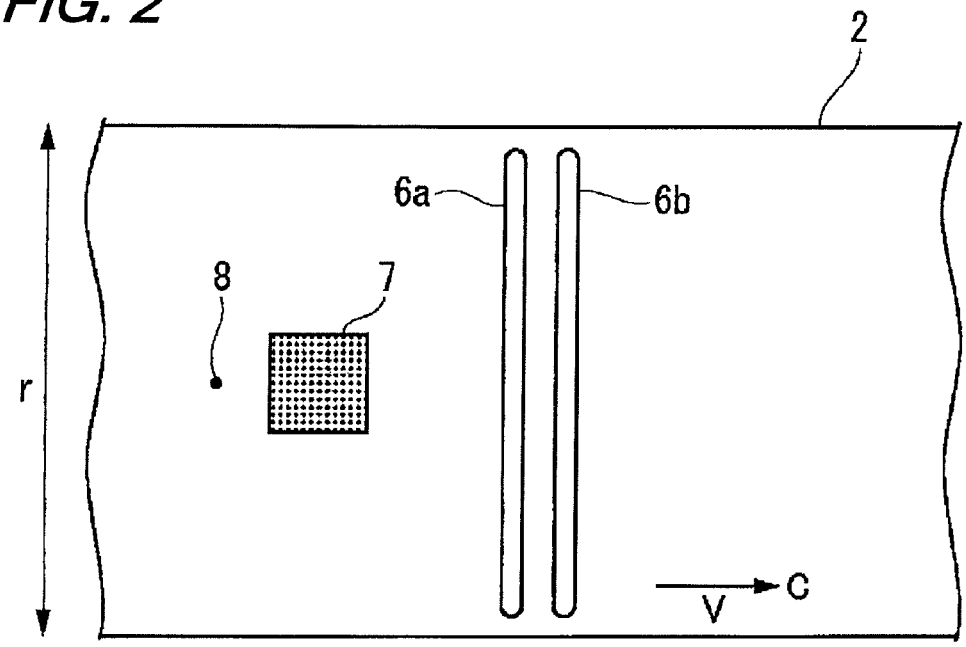
FIG. 2 is a plan view showing two laser irradiation regions that are formed by the fixing device according to this exemplary embodiment so as to extend linearly in the width direction of a recording medium.

Further, in FIG. 1B, the laser beam source 3*a* of the first laser beam irradiation unit 5*a* includes a plurality of laser beam generating elements 9, 9, . . . that is lined up at intervals p in the width direction r (for example, in the width direction of the recording sheet) crossing the conveying direction C (see FIG. 1A) of the recording medium 2. In this case, the irradiation regions on the recording medium 2, which are irradiated with the laser beams 4*a* emitted from the laser beam generating elements 9 adjacent to each other in the width direction r, overlap each other. Meanwhile, although not shown in FIG. 1B, the laser beam source 3*b* of the second laser beam irradiation unit 5*b* also has the same structure. Accordingly, laser beams, which extend linearly in the width direction r crossing the conveying direction C of the recording medium 2, are emitted. As a result, two laser irradiation regions 6*a* and 6*b*, which extend linearly in the width direction r of the recording medium 2, are formed as shown in FIG. 2.

Figure 3:
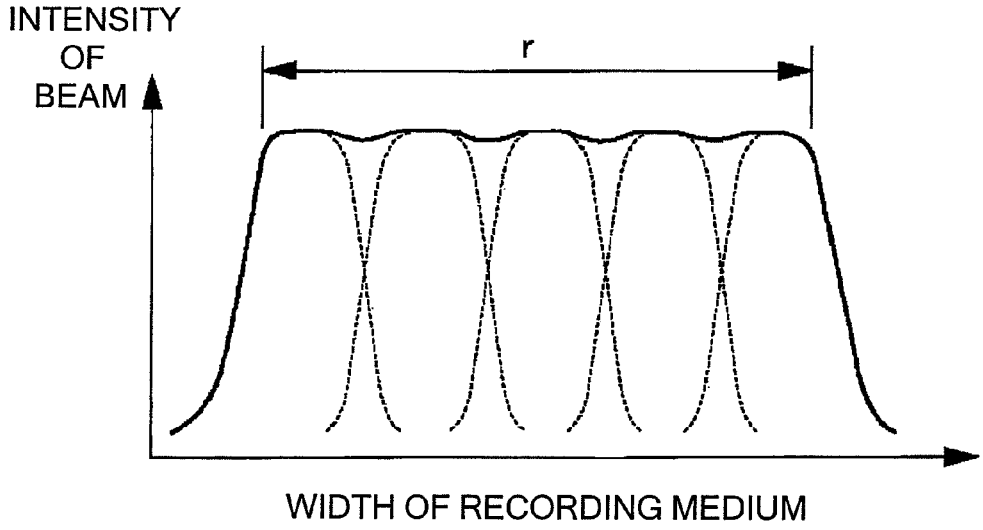
FIG. 3 is a graph showing the intensity of a laser beam, which is emitted from a laser beam irradiation unit of the fixing device, in the width direction crossing the conveying direction of a recording medium.

In this case, as shown in FIG. 3, the laser beams 4*a* and 4*b* emitted from the laser beam irradiation units 5*a* and 5*b* are adjusted so as to have a predetermined substantially constant intensity in the width direction r of the recording medium 2.

Meanwhile, in FIGS. 1A and 1B, slits, which are linearly elongated, may be formed at the laser beam irradiating portions of the first and second laser beam irradiation units 5*a* and 5*b*, and laser beams, which extend linearly, may be output through the slits.

Another embodiment of the first and second laser beam irradiation units 5*a* and 5*b* will be described below.

In FIG. 1A, it is preferable that the first laser beam irradiation unit 5*a* include a laser beam source 3*a* and luminous flux adjusting members (for example, collimator lenses) 10*a*. The laser beam source generates laser beams 4*a*. The luminous flux adjusting members diffuse the laser beams 4*a*, which are generated from the laser beam source 3*a*, over a predetermined distance in the width direction crossing the conveying direction C of the recording medium 2 and narrow the laser beam with a predetermined distance in the conveying direction C. Meanwhile, like the first laser beam irradiation unit 5*a*, the second laser beam irradiation unit 5*b* also includes a laser beam source 3*b* and luminous flux adjusting members (for example, collimator lenses) 10*b*.

According to this exemplary embodiment, the laser beams 4*a* and 4*b* generated from the laser beam sources 3*a* and 3*b* are emitted while being diffused over a predetermined distance in the width direction r crossing the conveying direction C of the recording medium 2 by the luminous flux adjusting members 10*a* and 10*b* and being narrowed with a predetermined distance in the conveying direction C. Even in this case, two laser irradiation regions 6*a* and 6*b*, which extend linearly in the width direction r of the recording medium 2, are formed as shown in FIG. 2.

Further, the first laser beam irradiation unit 5*a* may include a laser beam source 3*a* and luminous flux adjusting members (for example, collimator lenses) 10*a*. The laser beam source includes a plurality of laser beam generating elements that is lined up at the end of one substrate at a predetermined interval. The luminous flux adjusting members are provided at the ends of the emission portions for the laser beams 4*a* generated from the laser beam source 3*a*. The luminous flux adjusting members diffuse the laser beams 4*a* over a predetermined distance in the width direction r and narrow the laser beam with a predetermined distance in the conveying direction C. Meanwhile, like the first laser beam irradiation unit 5*a*, the second laser beam irradiation unit 5*b* also includes a laser beam source 3*b* and luminous flux adjusting members (for example, collimator lenses) 10*b*. The laser beam source includes a plurality of laser beam generating elements 9 that is lined up at the end of one substrate at a predetermined interval. The luminous flux adjusting members are provided at the ends of the emission portions for the laser beams 4*b* generated from the laser beam source 3*b*.

According to this exemplary embodiment, the laser beams 4*a* and 4*b* generated from the laser beam sources 3*a* and 3*b*, which include the plurality of laser beam generating elements lined up at the end of one substrate, are emitted while being diffused over a predetermined distance in the width direction r crossing the conveying direction C of the recording medium 2 by the luminous flux adjusting members 10*a* and 10*b* provided at the ends of the emission portions for the laser beams 4*a* and 4*b*. Further, the laser beams 4*a* and 4*b*, which linearly extend, are emitted while being narrowed with a predetermined distance in the conveying direction C. Even in this case, two laser irradiation regions 6*a* and 6*b*, which extend linearly in the width direction r of the recording medium 2, are formed as shown in FIG. 2.

Furthermore, an image forming apparatus, to which the fixing device according to this exemplary embodiment is applied, includes an image forming device that forms a toner image on a recording medium 2, and a fixing device 1 according to each exemplary embodiment that fixes a toner image formed by the image forming device to the recording medium 2.

Exemplary embodiments of the invention will be described in detail below with reference to the accompanying drawings.

First Exemplary Embodiment

Figure 4:
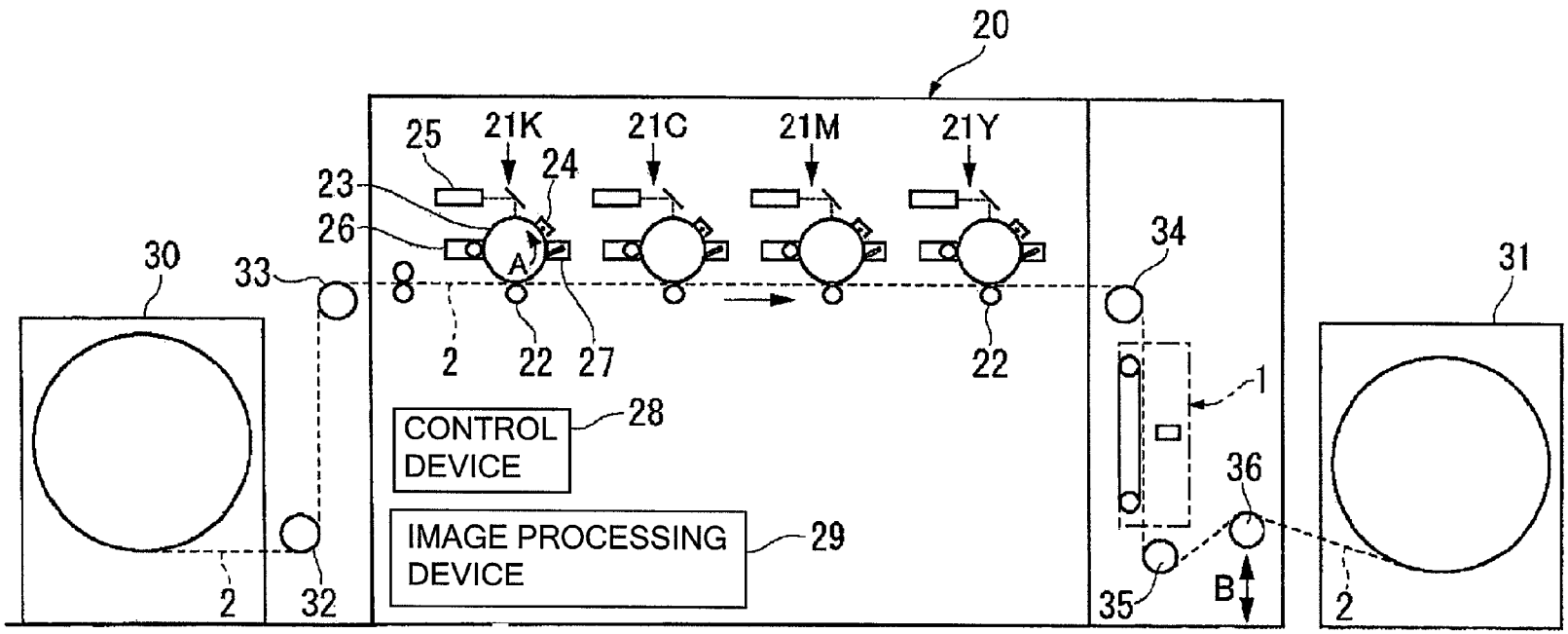
FIG. 4 is a view illustrating the entire structure of a first exemplary embodiment of an image forming apparatus to which the fixing device according to this exemplary embodiment is applied.

FIG. 4 is a view illustrating the entire structure of an exemplary embodiment of an image forming apparatus to which the fixing device according to this exemplary embodiment is applied. The image forming apparatus 20 forms a toner image on a recording medium, transfers the formed toner image to the recording medium, and fixes the transferred toner image to the recording medium. The image forming apparatus includes image forming devices 21, a transfer device 22, and a fixing device 1.

The image forming devices 21 form toner images on a recording medium 2 such as a recording sheet, for example, by an electrophotographic method. The image forming devices include image forming devices corresponding to, for example, four colors in order to form toner images having color components corresponding to a plurality of colors. Specifically, the image forming devices are formed of a black image forming device 21K, a cyan image forming device 21C, a magenta image forming device 21M, and a yellow image forming device 21Y. The respective color image forming devices 21K, 21C, 21M, and 21Y have the same structure except for color. Meanwhile, it is preferable that the toner have substantially the same absorption factor for laser beams used to fix the toner corresponding to the respective color components. In this case, the irradiation intensity and irradiation time of the laser beams, which are emitted from the plurality of laser beam irradiation units, are set to be the same in the fixing device 1, so that it is easy to fix the toner image.

The black image forming device 21K will be exemplified on behalf of the four color image forming devices. The black image forming device 21K includes a cylindrical photoreceptor that includes a photosensitive layer (not shown) on the surface thereof and is rotatable in a direction of an arrow A. A charging device 24, an exposure device 25, and a developing device 26 are provided around the photoreceptor 23. Among them, the charging device 24 charges the photosensitive layer of the photoreceptor 23 to a predetermined electric potential. The exposure device 25 includes a laser beam source (not shown), and forms an electrostatic latent image by selectively irradiating a laser beam to the photosensitive layer of the photoreceptor 23 that is charged to a predetermined electric potential by the charging device 24. The developing device 26 stores toner corresponding to the corresponding color component (here, black) as a developer, and makes the electrostatic latent image, which is formed on the photosensitive layer of the photoreceptor 23, be visible by the toner.

The transfer device 22 transfers the toner images, which are formed by the respective image forming devices 21K, 21C, 21M, and 21Y, to the recording medium 2. The transfer device includes a cylindrical or columnar transfer member that rotatably comes into contact with the photoreceptor 23 while applying pressure to the surface of the photoreceptor 23. The transfer device transfers the toner image, which is formed on the photoreceptor 23, to the recording medium 2 by applying a transfer bias between the transfer member and the photoreceptor 23.

In addition, a photoreceptor cleaner 27 is provided around the photoreceptor 23. The photoreceptor cleaner 27 removes residual toner attached to the photoreceptor 23 after the toner image is transferred to the recording medium 2 by the transfer device 22.

Meanwhile, in FIG. 4, a control device 28 controls the respective image forming devices 21K, 21C, 21M, and 21Y, the transfer device 22, and a fixing device 1 to be described below. Further, an image processing device 29 performs a process for forming an image on the recording medium 2.

Here, in the exemplary embodiment shown in FIG. 4, continuous recording paper wound around a core or continuous recording paper folded to a predetermined size is used as the recording medium 2. That is, the recording medium 2 is loaded on a sheet feed device 30 provided outside the image forming apparatus 20, and is wound up by the sheet winding device 31 provided outside the image forming apparatus likewise. Further, the continuous recording paper fed from the sheet feed device 30 is conveyed to the above-mentioned respective image forming devices 21K, 21C, 21M, and 21Y, and black, cyan, magenta, and yellow toner images are transferred to the continuous recording paper in this order. Then, the recording medium is conveyed to the fixing device 1, the toner image is fixed to the recording medium by the irradiation of the laser beam, and the recording medium is wound up by the sheet winding device 31 provided outside the image forming apparatus.

The position of the continuous recording paper is adjusted by a plurality of position adjusting rollers 32, 33, 34, and 35 provided on a path where the continuous recording paper passes so that the position of the continuous recording paper is not deviated during the conveyance of the continuous recording paper. The adjustment of the position of the continuous recording paper is a process that is to be performed before the image is transferred to the recording medium 2. Further, a tension applying roller 36 provided at the end is supported by a pushing member (not shown) so that the tension applying roller is movable in a direction of an arrow B and tension reaches a predetermined intensity during the conveyance of the continuous recording paper. While the continuous recording paper is wound up, the position of the continuous recording paper is adjusted by the tension applying roller 36 so that the continuous recording paper is not broken.

The detailed structure of the fixing device 1 for fixing the toner image, which is transferred by the transfer device shown in FIG. 4, to the recording medium 2 will be described here with reference to FIGS. 5 and 6.

Figure 5:
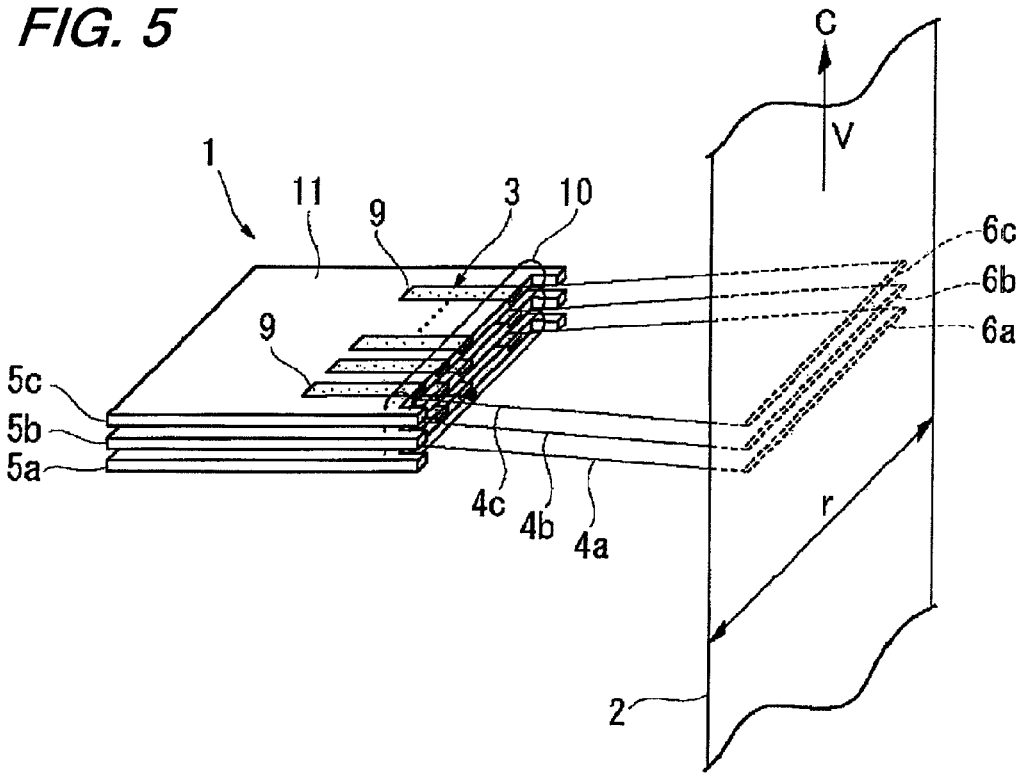
FIG. 5 is a perspective view of the fixing device according to a first exemplary embodiment.
Figure 6:
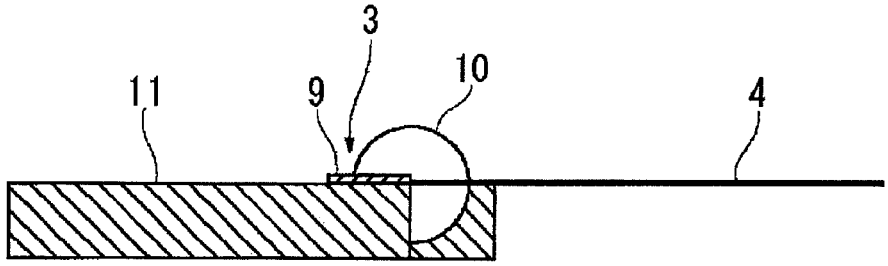
FIG. 6 is an enlarged cross-sectional view of the laser beam irradiation unit of the fixing device.

In FIG. 5, the fixing device 1 according to the first exemplary embodiment includes a plurality of, for example, three laser beam irradiation units 5*a*, 5*b*, and 5*c*. The respective laser beam irradiation units 5*a*, 5*b*, and 5*c* diffuse laser beams 4*a*, 4*b*, and 4*c*, which are generated from inside, over a predetermined distance in the width direction r crossing the conveying direction C of the recording medium 2, and emit the laser beams so that the laser beams are narrowed with a predetermined distance in the conveying direction C. The fixing device 1 includes a laser beam source 3 and luminous flux adjusting members 10. The laser beam source 3 includes a plurality of laser beam generating elements (for example, semiconductor laser elements) 9 that are lined up at the end of one substrate 11 at intervals p (see FIG. 18). The luminous flux adjusting members are provided at the ends of the emission portions for the laser beams 4 generated from the laser beam generating elements 9 of the laser beam source 3 shown in FIG. 6. Meanwhile, the luminous flux adjusting members 10 diffuse the laser beams 4, which are generated from the laser beam generating elements 9, over a predetermined distance in the width direction r crossing the conveying direction C of the recording medium 2 and emit the laser beams so that the laser beams are narrowed with a predetermined distance in the conveying direction C. For example, the luminous flux adjusting members are formed of cylindrical collimator lenses that extend in the width direction of the substrate 11.

The laser beam irradiation units 5*a*, 5*b*, and 5*c* are disposed so as to be spaced apart from the surface of the recording medium 2, which is conveyed in a direction of an arrow C, by a distance d (see FIG. 1A), and are disposed with a gap f (see FIG. 1A) therebetween in the conveying direction C of the recording medium 2. As a result, three laser irradiation regions 6*a*, 6*b*, and 6*c*, which extend linearly in the width direction r of the recording medium 2, are formed as shown in FIG. 5. Values of p, d, and f shown in FIGS. 1A and 1B are appropriately set.

Meanwhile, the recording medium 2 is conveyed in a direction of an arrow C by a conveying mechanism, which includes two conveying rollers (not shown) and a conveying belt stretched between the two conveying rollers, while being placed on the conveying belt.

Further, three laser beam irradiation units 5*a*, 5*b*, and 5*c*, which are formed by laminating three substrates 11 with a predetermined gap therebetween, have been shown in FIG. 5. However, the invention is not limited thereto, and the number of laser beam irradiation units may be two or four or more.

The operation of the fixing device 1 having the above-mentioned structure will be described below. An exemplary embodiment where the fixing device 1 shown in FIG. 5 includes two laser beam irradiation units 5*a* and 5*b* will be described here in order to simplify the description.

In FIG. 5, a recording medium 2, which is fed to the fixing device 1 from a transfer device 22 (not shown), is conveyed in a direction of an arrow C, and laser beams 4*a* and 4*b* are emitted to a toner image 7 having high image density and a toner image 8 having low image density (see FIGS. 1A and 2), which are transferred to the recording medium 2, from the first and second laser beam irradiation units 5*a* and 5*b*. Here, the beam power of the laser beam 4*a* emitted from the first laser beam irradiation unit 5*a* is denoted by W1 and the width of an irradiation region of the laser beam is denoted by A1. Further, the beam power of the laser beam 4*b* emitted from the second laser beam irradiation unit 5*b* is denoted by W2 and the width of an irradiation region of the laser beam is denoted by A2. In this case, the laser beams 4*a* and 4*b* are emitted while satisfying a condition of "W1=W2 and A1=A2" (Condition 1). Furthermore, as shown in FIG. 5, two laser irradiation regions 6*a* and 6*b*, which extend linearly in the width direction r of the recording medium, are formed on the surface of the recording medium 2.

Further, since the recording medium 2 is conveyed at a predetermined conveying speed v (for example, 500 mm/sec) by a conveying mechanism (not shown), a laser beam is emitted to the toner images 7 and 8, which are formed on the recording medium 2, two times at a predetermined time interval (for example, 5 msec) while two laser beams 4*a* and 4*b* are emitted from the first and second laser beam irradiation units 5*a* and 5*b* (Condition 2). That is, in FIG. 2, the toner image 7 having high image density and the toner image 8 having low image density enter and pass through the two laser irradiation regions 6*a* and 6*b*, which are formed on the surface of the recording medium 2, at a predetermined time interval. In this case, since the laser beams 4*a* and 4*b* emitted from the laser beam irradiation units 5*a* and 5*b* satisfy the condition of "W1=W2 and A1=A2" as described above, the laser beams are emitted under that condition where the irradiation time and the irradiation intensity of the laser beams per unit area of the recording medium 2 are the same as each other.

Further, due to the above-mentioned irradiation of the laser beams 4*a* and 4*b*, the toner heating temperature of the interfacial portions between the surface of the recording medium 2 and the toner images 7 and 8 formed on the recording medium 2 reaches toner fixing temperature in the irradiation of at least the final (for example, second in the case of two light sources) laser beam except for the irradiation of one laser beam among the irradiation of the plurality of laser beams 4*a* and 4*b* (Condition 3). Accordingly, not only the toner image 7 having high image density but also the toner image 8 having low image density is fixed to the recording medium 2.

Figure 7:
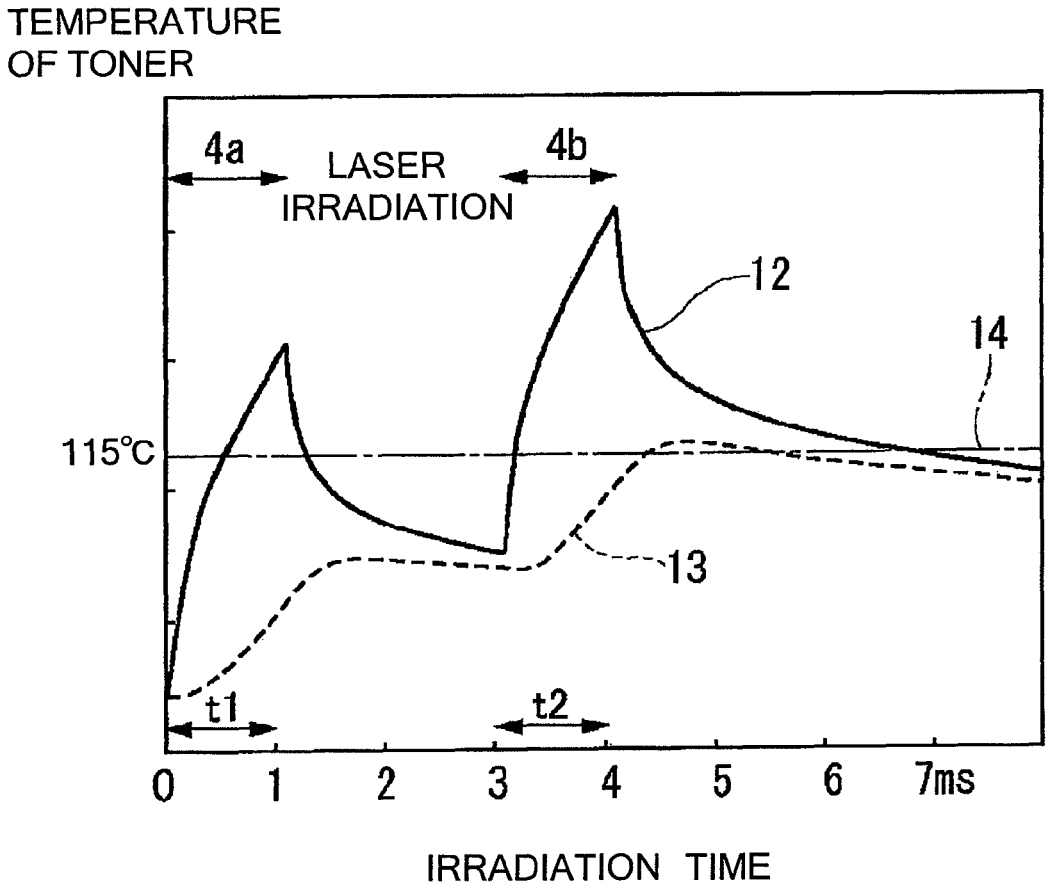
FIG. 7 is a graph showing a relationship between the change in toner temperature and irradiation time when laser beams are emitted to a toner image having high image density from first and second laser beam irradiation units.
Figure 9:
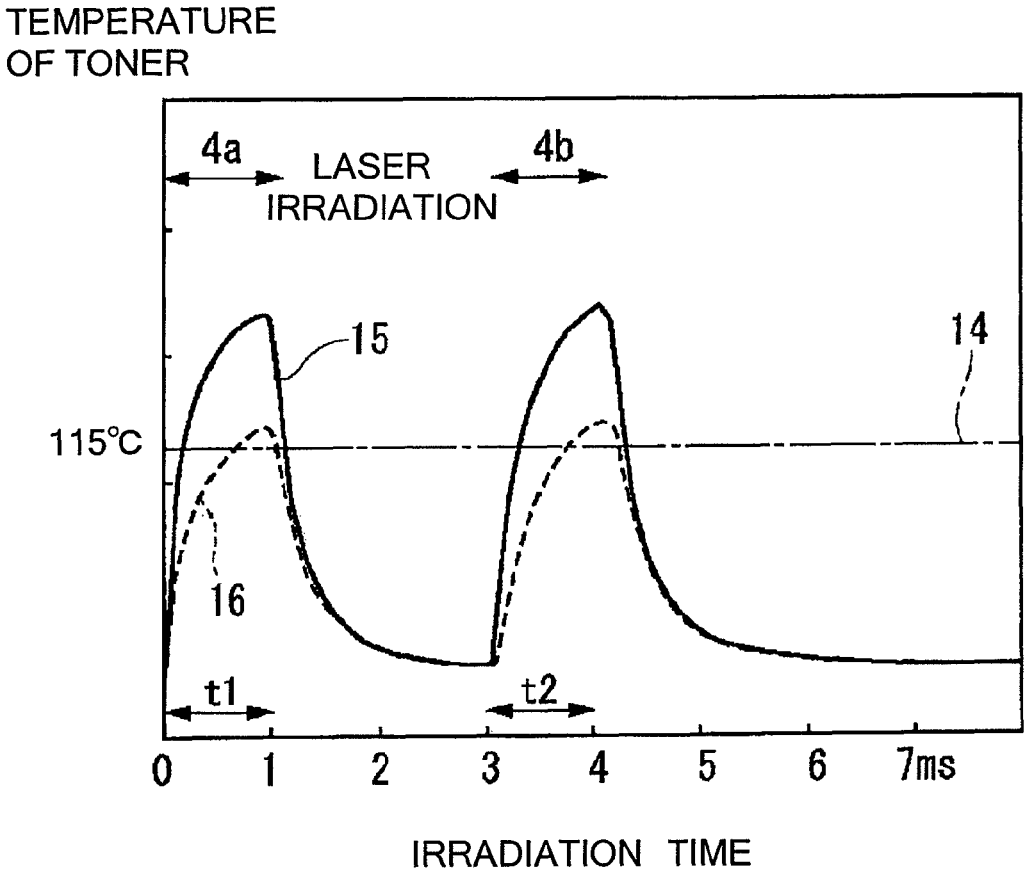
FIG. 9 is a graph showing a relationship between the change in toner temperature and irradiation time when laser beams are emitted to a toner image having low image density from first and second laser beam irradiation units.

Here, graphs shown in FIGS. 7 and 9 show a relationship between the change in toner temperature and irradiation time when the laser beams 4*a* and 4*b* are emitted to the toner image 7 having high image density and the toner image 8 having low image density from first and second laser beam irradiation units 5*a* and 5*b*.

FIG. 7 is a graph showing a relationship between the change in toner temperature and irradiation time when the laser beams 4*a* and 4*b* are emitted to the toner image 7 having high image density from first and second laser beam irradiation units 5*a* and 5*b*. In this case, the toner image 7 is a black image that is obtained by superimposing and transferring cyan, magenta, and yellow toner images in this order. The first laser beam 4*a* is emitted to the black image from the first laser beam irradiation unit 5*a* at a predetermined beam power W1 for an irradiation time t1 of 1 ms. Then, a laser beam is not emitted to the black image for 2 msec. After that, the second laser beam 4*b* is emitted to the black image from the second laser beam irradiation unit 5*b* with the same beam power W2 as the beam power as that of the first laser beam 4*a* for an irradiation time t2 of 1 msec likewise.

In FIG. 7, the toner temperature of a surface layer portion of the toner image 7 formed on the recording medium 2 is represented by a solid change curve 12, the toner temperature of the interfacial portion between the surface of the recording medium 2 and the toner image is represented by a dashed change curve 13, and toner fixing temperature is represented by a dashed-dotted line 14. Here, the toner fixing temperature is 115° C. As shown in FIG. 7, in the irradiation of the first laser beam 4*a* of the first laser beam irradiation unit 5*a*, the toner temperature of the surface layer portion of the toner image 7 exceeds the toner fixing temperature (solid change curve 12). However, the toner temperature of the interfacial portion between the recording medium 2 and the toner image does not exceed the toner fixing temperature (dashed change curve 13).

Then, while a laser beam is not emitted for 2 ms, the toner temperature of the surface layer portion of the toner image 7 is also lowered below the toner fixing temperature together with the toner temperature of the interfacial portion between the recording medium 2 and the toner image (solid change curve 12 and dashed change curve 13). Accordingly, in the irradiation of the first laser beam 4*a*, the toner image 7 is not fixed as a whole.

After that, since the second laser beam 4*b* is emitted by the second laser beam irradiation unit 5*b*, the surface layer portion is heated from a state where the surface layer portion is cooled after the irradiation of the first laser beam 4*a*. Accordingly, the toner temperature of the surface layer portion of the toner image 7 exceeds the toner fixing temperature again (solid change curve 12), and the toner temperature of the interfacial portion between the recording medium 2 and the toner image also exceeds the toner fixing temperature (dashed change curve 13). That is, the entire portion of the toner image 7 between the surface layer portion and the interfacial portion, which is formed between the recording medium 2 and the toner image, reaches the toner fixing temperature due to the irradiation of the second laser beam 4*b*. Accordingly, the toner image 7 is fixed as a whole by the irradiation of the second (final) laser beam 4*b* through the irradiation of the first and second laser beams 4*a* and 4*b*.

Figure 8A:
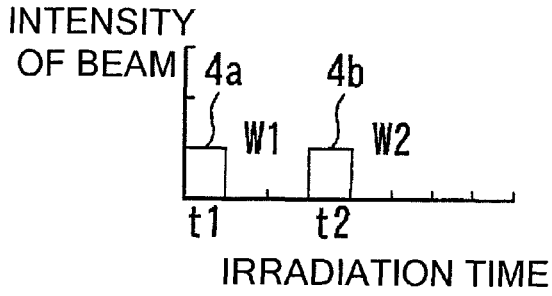
FIGS. 8A to 8E are graphs each showing cases regarding a relationship between irradiation time and the beam power (beam intensity) of the laser beams emitted from the first and second laser beam irradiation units.

Each of FIGS. 8A to 8E is graph showing a relationship between irradiation time of a laser beam that is emitted to the toner image formed on the recording medium 2 and the beam power (beam intensity) of a laser beam that is emitted to the toner image formed on the recording medium 2, as for the laser beams emitted from the first and second laser beam irradiation units 5*a* and 5*b*. FIG. 8A is a graph showing a case where the irradiation (irradiation time t1) of the first laser beam 4*a* and the irradiation (irradiation time t2) of the second laser beam 4*b* are performed at a predetermined interval (for example, 2 ms) in this exemplary embodiment as shown in FIG. 7. In this case, as described above, the toner image 7 is fixed as a whole through the irradiation of the first and second laser beams 4*a* and 4*b*.

Figure 8B:
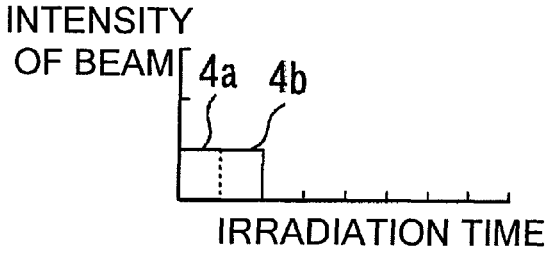
Figure 8C:
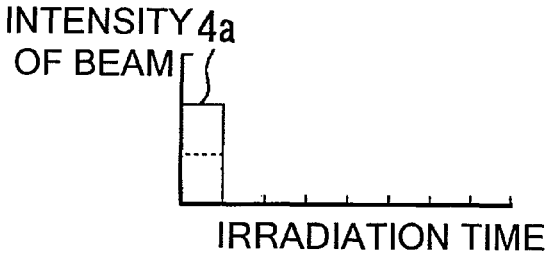

FIG. 8B is a graph showing a case where the irradiation (irradiation time t1) of the first and second laser beams 4*a* and 4*b* having the same beam power (beam intensity) are continuously performed at time intervals (like when one light source is used and irradiation time is increased to double) in a first comparative embodiment. In this case, a large difference occurs between the temperature of the surface layer portion of the toner image 7 and the temperature of the interfacial portion between the recording medium 2 and the toner image and cavities are generated at an inner layer portion. For this reason, there is a concern that image defects are generated. As shown in FIG. 8C, this phenomenon frequently occurs when the intensity of the beam is increased to fix a toner image by the irradiation of the beam for a short time.

Figure 8D:
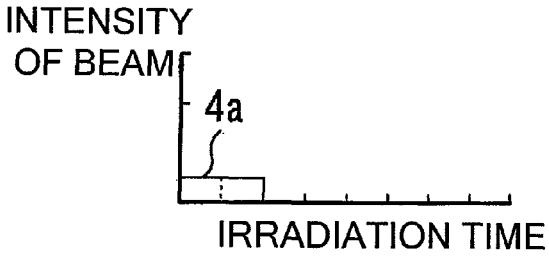

Further, FIG. 8D is a graph showing a case where the irradiation of the first laser beam 4*a* is performed only one time while the irradiation intensity of the first laser beam is reduced to a half and the irradiation time is increased to double in a second comparative embodiment. In this case, the toner image 7 is fixed well, but there are possibilities that the temperature of the interfacial portion between the recording medium 2 and the toner image 8 does not reach the fixing temperature and the toner image is not sufficiently fixed as a whole.

Figure 8E:
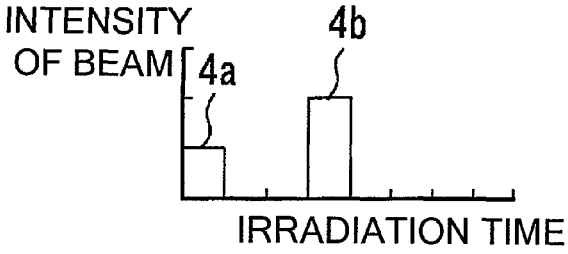

Furthermore, FIG. 8E is a graph showing a case where the irradiation of the first and second laser beams 4*a* and 4*b* are performed at predetermined time intervals while the irradiation intensity of the second laser beam 4*b* is larger than that of the first laser beam 4*a* in a third comparative embodiment. In this case, there is required a unit for changing the irradiation intensity in the irradiation of the first and second laser beams 4*a* and 4*b* and the structure of the fixing device becomes complicated. Moreover, the difference occurs between the temperature of the surface layer portion of the toner image 7 and the temperature of the interfacial portion between the recording medium 2 and the toner image due to the irradiation of the second laser beam 4*b* having a large beam power (beam intensity), so that the toner image may not be fixed well.

FIG. 9 is a graph showing a relationship between the change in toner temperature and irradiation time when the laser beams 4*a* and 4*b* are emitted to the toner image 8 having low image density from first and second laser beam irradiation units 5*a* and 5*b*. In this case, the toner image 8 is an unfixed toner image having about one, two, or three toner particles. The first laser beam 4*a* is emitted to the toner image 8 from the first laser beam irradiation unit 5*a* with a predetermined beam power W1 for an irradiation time t1 of 1 ms. Then, a laser beam is not emitted to the toner image for 2 ms. After that, the second laser beam 4*b* is emitted to the toner image from the second laser beam irradiation unit 5*b* with the same beam power W2 as the beam power as that of the first laser beam 4*a* for an irradiation time t2 of 1 ms likewise.

In FIG. 9, the toner temperature of a surface layer portion of the toner image 8 formed on the recording medium 2 is represented by a solid change curve 15, the toner temperature of the interfacial portion between the surface of the recording medium 2 and the toner image is represented by a dashed change curve 16, and toner fixing temperature is represented by a dashed-dotted line 14. Here, the toner fixing temperature is 115° C. As shown in FIG. 9, due to the irradiation of the first laser beam 4*a* of the first laser beam irradiation unit 5*a*, the toner temperature of the surface layer portion of the toner image 8 exceeds the toner fixing temperature (solid change curve 15), and the toner temperature of the interfacial portion between the recording medium 2 and the toner image also exceeds the toner fixing temperature (dashed change curve 16). In this case, the toner image 8 is fixed by the irradiation of the first laser beam 4*a*.

Then, while a laser beam is not emitted for 2 ms, the toner temperature of the surface layer portion of the toner image 8 is also lowered to the toner temperature, which is obtained before the irradiation of the first laser beam 4*a*, together with the toner temperature of the interfacial portion between the recording medium 2 and the toner image (solid change curve 15 and dashed change curve 16). The reason for this is that the amount of radiated heat is increased since the contact area between each toner particle and air is large in the toner image, which has low image density and has about one, two, or three toner particles.

After that, since the second laser beam 4*b* is emitted by the second laser beam irradiation unit 5*b*, the toner temperature of the surface layer portion of the toner image 8 exceeds the toner fixing temperature (solid change curve 15) and the toner temperature of the interfacial portion between the recording medium 2 and the toner image also exceeds the toner fixing temperature (dashed change curve 16), as in the case of the irradiation of the first laser beam 4*a*. Accordingly, the toner image 8 is fixed even by the irradiation of the second laser beam 4*b*.

Meanwhile, in the above description of the operation, there has been described an exemplary embodiment where the fixing device 1 shown in FIG. 5 includes two laser beam irradiation units 5*a* and 5*b*. However, even though including three or more laser beam irradiation units, the fixing device operates in the same manner as described above. For example, if the fixing device shown in FIG. 5 includes three laser beam irradiation units 5*a*, 5*b*, and 5*c*, the toner temperature of the surface layer portion of the toner image 7 exceeds the toner fixing temperature and the toner temperature of the interfacial portion between the image and the surface of the recording medium 2 also exceeds the toner fixing temperature in the irradiation of at least the final (third) laser beam except for the irradiation of the first laser beam in a graph that shows a relationship between the change in toner temperature and irradiation time shown in FIG. 7 as for a toner image 7 having high image density.

In this case, depending on the irradiation time and beam power of a laser beam, for example, due to the irradiation of the second laser beam, the entire portion of the toner image 7 between the surface layer portion and the interfacial portion, which is formed between the recording medium 2 and the toner image, may reach the toner fixing temperature and the toner image 7 may be fixed as a whole. That is, due to the irradiation of at least the final (third) laser beam except for the irradiation of the first laser beam, the entire portion of the toner image 7 between the surface layer portion and the interfacial portion, which is formed between the recording medium 2 and the toner image, reaches the toner fixing temperature and the toner image 7 is fixed as a whole.

In this case, due to the irradiation of at least one laser beam of the first to third laser beams, the toner temperature of the surface layer portion of the toner image 8 exceeds the toner fixing temperature and the toner temperature of the interfacial portion between the image and the surface of the recording medium 2 also exceeds the toner fixing temperature in a graph that shows a relationship between the change in toner temperature and irradiation time shown in FIG. 9 as for a toner image 8 having low image density.

In this case, depending on the irradiation time and beam power of a laser beam, for example, due to the irradiation of the second or third laser beam, the entire portion of the toner image 8 between the surface layer portion and the interfacial portion, which is formed between the recording medium 2 and the toner image, may reach the toner fixing temperature and the toner image 8 may be fixed as a whole. That is, due to the irradiation of at least the final (third) laser beam, the entire portion of the toner image 8 between the surface layer portion and the interfacial portion, which is formed between the recording medium 2 and the toner image, reaches the toner fixing temperature and the toner image 8 is fixed as a whole.

Second Exemplary Embodiment

Figure 10:
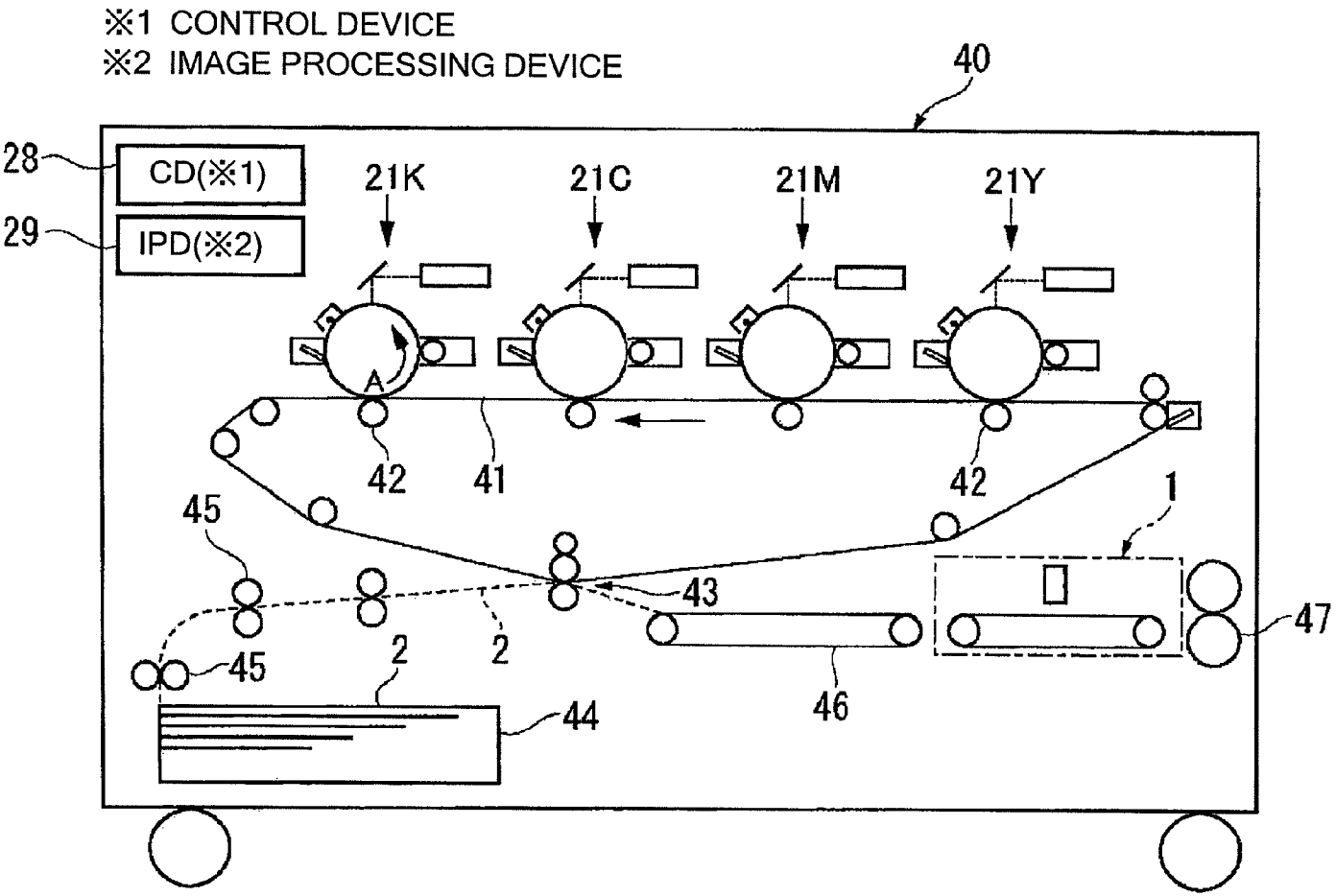
FIG. 10 is a view illustrating the entire structure of an image forming apparatus according to a second exemplary embodiment.

FIG. 10 is a view illustrating the entire structure of an image forming apparatus according to a second exemplary embodiment. The image forming apparatus 20 shown in FIG. 4 uses continuous recording paper wound around a core or continuous recording paper folded to a predetermined size as the recording medium 2. However, the invention is not limited thereto, and the image forming apparatus may use a recording sheet that is cut to a predetermined size, such as A4 or B4. As shown in FIG. 10, an image forming apparatus 40 according to this exemplary embodiment includes image forming devices, a first transfer device 42, a second transfer device 43, and a fixing device 1. The image forming devices (a black image forming device 21K, a cyan image forming device 21C, a magenta image forming device 21M, and a yellow image forming device 21Y) correspond to, for example, four colors. The first transfer device sequentially transfers toner images, which are formed by the respective image forming devices 21K, 21C, 21M, and 21Y, to an intermediate transfer belt 41. The second transfer device collectively transfers the superimposed images, which are transferred to the intermediate transfer belt 41, to a recording medium 2. The fixing device 1 fixes the images, which are transferred by the second transfer device 43, to the recording medium 2.

Meanwhile, in FIG. 10, reference numeral 44 denotes a recording sheet storing part that stores a plurality of recording mediums 2 including recording sheets. Reference numeral 45 denotes a conveying roller that takes out the recording medium 2 from the recording sheet storing part 44 and conveys the recording medium 2. Reference numeral 46 denotes a conveying belt for conveying the recording medium 2, to which the images have been transferred by the second transfer device 43, to the fixing device 1. Reference numeral denotes a discharge roller for discharging the recording medium 2, to which the images have been fixed by the fixing device 1, to the outside. Further, the reference numeral 28 denotes a control device that controls the respective color image forming devices 21K, 21C, 21M, and 21Y, the first transfer device 42, the second transfer device 43, and the fixing device 1. Reference numeral 29 denotes an image processing device that performs a process for forming an image on the recording medium 2.

EXAMPLES

The invention will be described in more detail below with reference to examples that make a prototype of the fixing device and perform a fixing experiment for fixing a toner image to a recording medium.

Example 1

First, DocuColor 1256GA (electrophotographic apparatus) manufactured by Fuji Xerox Co., Ltd. was used as an image forming apparatus. In the image forming apparatus, a recording medium, to which unfixed toner images were transferred, was formed by using the following toner for laser fixing as an image forming material.

As the toner for laser fixing, there was used an image forming material obtained by adding 0.5% of an infrared absorbing material, which absorbs a beam of which the wavelength was similar to the wavelength of a laser beam, to color toner, such as yellow, magenta, and cyan toner so that the image forming material absorbed the laser beam. For example, there was an image forming material containing a perimidine squarylium dye. The infrared absorbing material has low absorbancy in a visible light wavelength region where a wavelength is equal to or larger than 400 nm and smaller than 750 nm, and has high absorbancy in a near-infrared light wavelength region where a wavelength is equal to or larger than 750 nm and smaller than 1000 nm. In this example, a perimidine squarylium dye represented by the following structural formula (I) was used as the infrared absorbing material. It may be possible to obtain this material by a method disclosed in Japanese Patent Application No. 2008-055291.

(I)

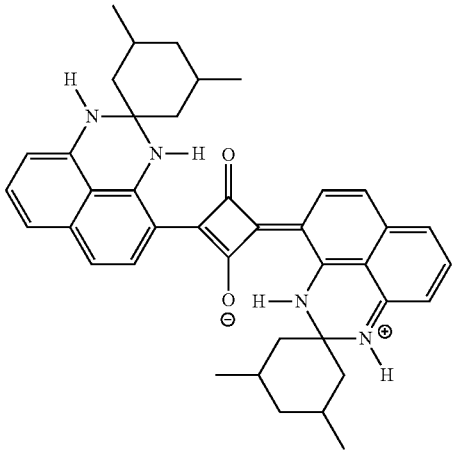

Further, as laser beam irradiation devices of a fixing device 1, there were used two laser beam irradiation devices (which correspond to reference numerals 5*a* and 5*b* shown in FIG. 1) that include semiconductor laser arrays of 9001-60-808 (wavelength: 808 nm and beam power: 60 W) manufactured by Coherent Inc. The conveying speed of a recording medium 2 was set to 500 m/s.

In this state, the laser beam irradiation units 5*a* and 5*b* were disposed above a moving stage that conveys the recording medium 2 so that the laser irradiation regions 6*a* and 6*b* shown in FIG. 2 had a beam width of 0.5 mm in a direction following the conveying direction C of the recording medium 2, a beam length of 10 mm in a width direction crossing the conveying direction C, and a gap of 2 mm therebetween. The recording medium 2 to which the unfixed toner images 7 and 8 were transferred was loaded on the moving stage. Further, the beam power of each of the laser beam irradiation units 5*a* and 5*b* was adjusted to 30 W. While laser beams were emitted, the moving stage was moved at a conveying speed 500 mm/s and the laser beams were emitted to the unfixed toner images 7 and 8 transferred to the recording medium 2, so that the toner images were fixed.

Example 2

In Example 2, the same image forming apparatus and toner for laser fixing as those of Example 1 were used and the following fixing device 1 was used.

As laser beam irradiation devices of the fixing device 1, there were used stacked laser beam irradiation units where two semiconductor laser arrays (which correspond to reference numerals 5*a* and 5*b* shown in FIG. 5) of 9001-60-808 (wavelength: 808 nm and beam power: 60 W) manufactured by Coherent Inc. are stacked. The conveying speed of a recording medium 2 was set to 500 m/s.

In this state, the laser beam irradiation units 5*a* and 5*b* were disposed above a moving stage for conveying the recording medium 2 so that the laser irradiation regions 6*a* and 6*b* shown in FIG. 2 had a beam width of 0.5 mm in a direction following the conveying direction C of the recording medium 2, a beam length of 10 mm in a width direction crossing the conveying direction C, and a gap of 1 mm therebetween. The recording medium 2 to which the unfixed toner images 7 and 8 were transferred was loaded on the moving stage. Further, the beam power of each of the laser beam irradiation units 5*a* and 5*b* was adjusted to 30 W. While laser beams were emitted, the moving stage was moved at a conveying speed 500 mm/s and the laser beams were emitted to the unfixed toner images 7 and 8 transferred to the recording medium 2, so that the toner images were fixed.

Comparative Example 1

In Comparative example 1, the same image forming apparatus and toner for laser fixing as those of Example 1 were used and the following fixing device 1 was used.

As the fixing device, there was used a fixing device including one laser beam irradiation unit (which corresponds to reference numeral 5*a* shown in FIGS. 1A and 1B) that includes the semiconductor laser array of the fixing device 1 of Example 1. The conveying speed of a recording medium 2 was set to 500 m/s. The laser beam irradiation unit was disposed above a moving stage that conveys the recording medium 2 so that the laser irradiation region 6*a* shown in FIG. 2 had a beam width of 1 mm in a direction following the conveying direction C of the recording medium 2 and a beam length of 10 mm in a width direction crossing the conveying direction C. The recording medium 2 to which the unfixed toner images 7 and 8 were transferred was loaded on the moving stage. Further, the beam power of the laser beam irradiation unit was adjusted to 60 W. While a laser beam was emitted, the moving stage was moved at a conveying speed 500 mm/s and the laser beam was emitted to the unfixed toner images 7 and 8 transferred to the recording medium 2, so that the toner images were fixed.

Comparative Example 2

In Comparative example 2, the same image forming apparatus and toner for laser fixing as those of Example 1 were used and the following fixing device 1 were used.

As the fixing device, there was used a fixing device including one laser beam irradiation unit (which corresponds to reference numeral 5*a* shown in FIGS. 1A and 1B) that includes the semiconductor laser array of the fixing device 1 of Example 1. The conveying speed of a recording medium 2 was set to 500 m/s. The laser beam irradiation unit was disposed above a moving stage that conveys the recording medium 2 so that the laser irradiation region 6*a* shown in FIG. 2 had a beam width of 5 mm in a direction following the conveying direction C of the recording medium 2 and a beam length of 10 mm in a width direction crossing the conveying direction C. The recording medium 2 to which the unfixed toner images 7 and 8 were transferred was loaded on the moving stage. Further, the beam power of the laser beam irradiation unit was adjusted to 60 W. While a laser beam was emitted, the moving stage was moved at a conveying speed 500 mm/s and the laser beam was emitted to the unfixed toner images 7 and 8 transferred to the recording medium 2, so that the toner images were fixed.

Evaluation of Examples and Comparative Examples

A table of FIG. 11 shows the results of the evaluation of the fixing properties of images (toner images) fixed to the recording media 2 that were obtained from the above-mentioned Examples 1 and 2 and Comparative examples 1 and 2. Meanwhile, a method of evaluating the fixing properties of image regions (high image density portions) shown in a table of FIG. 11 and the fixing properties of non-image regions (low image density portions), and evaluation criteria therefor will be described below.

First, as for the image regions of the recording medium 2, a recording sheet was folded in half at a certain position of the image region so that images were positioned inward. Then, the recording sheet was turned back, and the recording sheet was rubbed with a cotton cloth. Further, whether images (toner images) of a folded portion were peeled and image defects were generated were visually observed and evaluated on the basis of the following criteria.

A: the images (toner image) are not peeled and image defects are also not generated at the folded portion.

B: the peeling of the images (toner images) appears at the folded portion along a folding line.

C: the peeling of the images (toner images) is generated even near the folding line or noticeable image defects are generated at the folded portion.

After that, as for the non-image regions (low image density portions) of the recording medium 2, an image surface having an image density of 10% was rubbed with a cotton cloth with a predetermined pressure, and the comparison of the change in the image density before and after the rubbing were visually observed and evaluated on the basis of the following criteria.

A: the image density is not changed before and after the rubbing.

B: the change of the image density appears before and after the rubbing.

C: the image density after the rubbing significantly deteriorates in comparison with the image density before the rubbing.

[Result of the Evaluation]

The results of the evaluation of the fixing property, which are based on the above-mentioned evaluation method and evaluation criteria, were shown in the table of FIG. 11.

Example 1 had a good fixing property without the peeling of the toner images in not only the image regions but also the non-image regions.

Example 2 had a good fixing property without the peeling of the toner images in not only the image regions but also the non-image regions.

Comparative example 1 had no peeling of the toner images in not only the image regions but also the non-image regions, but had cavities at the inner layer portion in the image regions, so that image defects were generated. Accordingly, Comparative example 1 had a poor fixing property in the image regions.

Comparative example 2 had no peeling of the toner images in the image regions, but had the peeling of the toner images in the non-image regions. Accordingly, Comparative example 2 had a poor fixing property in the non-image regions.

The foregoing description of the exemplary embodiment of the present invention has been provided for the purpose of illustration and description. It is not intended to be exhaustive or to limit the invention to the precise forms disclosed. Obviously, many modifications and various will be apparent to practitioners skilled in the art. The exemplary embodiments were chosen and described in order to best explain the principles of the invention and its practical application, thereby enabling other skilled in the art to understand the invention for various embodiments and with the various modifications as are suited to the particular use contemplated. It is intended that the scope of the invention be defined by the following claims and their equivalents.

What is claimed is:

1. A fixing device comprising:

a plurality of laser beam irradiation units each of which includes a plurality of laser beam sources and emits a plurality of laser beams, generated by plurality of the laser beam sources, to a surface of a recording medium, and a conveying unit that conveys the recording medium and/or plurality of the laser beam irradiation units such that regions on the recording medium irradiated with the plurality of laser beams are moved relative to the conveyed recording medium in a conveying direction, wherein adjacent two of the plurality of laser beam irradiation units are disposed with a gap therebetween in the conveying direction of the recording medium and the plurality of laser beams emitted from one of the laser beam irradiation units is spatially independent from the plurality of laser beams emitted from the other of the laser beam irradiation units, wherein when the plurality of laser beams is emitted to a toner image formed on the recording medium so as to fix the toner image to the recording medium, the plurality of laser beams satisfies the following conditions:

(A) the plurality of laser beams has substantially the same beam power and substantially the same width in the conveying direction in the irradiated regions, and (B) the plurality of laser beams is independently emitted to the toner image, and, (C) when the toner image includes a plurality of toner layers, toner temperature of interfacial portions between the toner image and the surface of the recording medium reaches toner fixing temperature in the irradiation except for the irradiation of a first laser beam among the plurality of laser beams, and wherein each of the plurality of laser beam irradiation units includes a plurality of laser beam generating elements lined up along a direction crossing the conveying direction.

2. The fixing device according to claim 1, further comprising:

luminous flux adjusting members that narrow the plurality of laser beams with a predetermined distance in the conveying direction.

3. An image forming apparatus comprising:

image forming device that forms toner image on a recording medium; and a fixing device includes:

a plurality of laser beam irradiation units each of which includes a plurality of laser beam sources and emits a plurality of laser beams, generated by the plurality of laser beam sources, to a surface of the recording medium, and a conveying unit that conveys the recording medium and/or the plurality of laser beam irradiation unit such that regions on the recording medium irradiated with the plurality of laser beams are moved relative to the conveyed recording medium in a conveying direction, wherein adjacent two of the plurality of laser beam irradiation units are disposed with a gap therebetween in the conveying direction of the recording medium and the plurality of laser beams emitted from one of the laser beam irradiation units is spatially independent from the plurality of laser beams emitted from the other of the laser beam irradiation units, wherein when the plurality of laser beams is emitted to the toner image so as to fix the toner image to the recording medium, the plurality of laser beams satisfies following conditions:

(A) the plurality of laser beams has substantially the same beam power and substantially the same width in the conveying direction in the irradiated regions, (B) the plurality of laser beams is independently emitted to the toner image, and (C) when the toner image includes a plurality of toner layers, toner temperature of interfacial portions between the toner image and the surface of the recording medium reaches toner fixing temperature in the irradiation except for the irradiation of a first laser beam among the plurality of laser beams, and wherein each of the plurality of laser beam irradiation units includes a plurality of laser beam generating elements lined up along a direction crossing the conveying direction.

4. The image forming apparatus according to claim 3, wherein the fixing device further includes luminous flux adjusting members that narrow the plurality of laser beams with a predetermined distance in the conveying direction.

5. A method for fixing a toner image to a recording medium, the method comprising:

generating the toner image on the recording medium;

irradiating the toner image with a first laser beam generated by a first laser beam unit while moving the recording medium in a conveying direction relative to the first laser beam unit; and irradiating the toner image with one or more second laser beams generated by at least one of second laser beam units, wherein the first laser beam irradiation unit and said at least one second laser beam unit are disposed with a gap therebetween in the conveying direction of the recording medium and the first laser beam emitted from the first laser beam unit is spatially independent from the one or more second laser beams emitted from the second laser beam unit, wherein the first laser beam and the one or more second laser beams satisfy the following conditions:

(A) the first and second laser beams have substantially the same beam power and substantially the same width in the conveying direction in the irradiated regions, (B) the first and second laser beams are independently emitted to the toner image, and (C) when the toner image includes a plurality of toner layers, toner temperature of interfacial portions between the toner image and the surface of the recording medium is lower than toner fixing temperature during a period from the irradiation with the first laser beam to the irradiation with the second laser beams and reaches the toner fixing temperature by the irradiation with any one of the second laser beams, and wherein each of the first and second laser beam irradiation units includes a plurality of laser beam generating elements lined up along a direction crossing the conveying direction.

* * * * *